US005322052A

United States Patent [19]

McCrillis et al.

[11] Patent Number: 5,322,052

[45] Date of Patent: * Jun. 21, 1994

[54] FIREPLACE WITH DESTRUCTION OF PRODUCTS OF INCOMPLETE COMBUSTION ENHANCED BY A GASEOUS-FUELED PILOT BURNER

[75] Inventors: Robert C. McCrillis, Durham; Wade H. Ponder, Raleigh; Nelson L. Butts, Hillsborough; James H. Abbott, Cary, all of N.C.

[73] Assignee: The United States of America as represented by the Administrator of the U.S. Environmental Protection Agency, Washington, D.C.

[ * ] Notice: The portion of the term of this patent subsequent to Jan. 19, 2010 has been disclaimed.

[21] Appl. No.: 5,958

[22] Filed: Jan. 19, 1993

Related U.S. Application Data

[63] Continuation-in-part of Ser. No. 788,899, Nov. 7, 1991, Pat. No. 5,179,933.

[51] Int. Cl.[5] ..... F24C 1/14

[52] U.S. Cl. ..... 126/503; 126/77; 126/512; 110/214; 110/345; 422/182

[58] Field of Search ..... 126/77, 83, 112, 58, 126/67, 80, 60, 64, 512, 503, 515, 516; 110/211, 212, 214, 345, 210; 422/172, 181, 183, 173, 174; 431/2, 5, 10

[56] References Cited

U.S. PATENT DOCUMENTS

| | | | |
|---|---|---|---|
| 3,310,009 | 3/1967 | Jacobs | 110/212 |
| 4,078,541 | 3/1978 | Roycraft | 126/77 |
| 4,123,979 | 11/1978 | Tesch | 110/212 |
| 4,228,783 | 10/1980 | Kalenian | 126/77 |
| 5,007,404 | 4/1991 | Hail et al. | 110/214 |
| 5,179,933 | 1/1993 | McCrillis et al. | 126/77 |

*Primary Examiner*—James C. Yeung

*Attorney, Agent, or Firm*—Lowe, Price, LeBlanc & Becker

[57] ABSTRACT

Particulate emissions from a wood fire in a fireplace having a baffle for preventing the direct flow of fluid into the flue from the wood fire are reduced by locating a hydrocarbon gas pilot source in proximity to the baffle. Ignited gas from the pilot combines particulate emissions from the wood fire while they are in the fireplace and before they reach the flue. Air from outside of the fireplace is supplied into proximity with ignited pilot gas so the outside air and the ignited pilot gas mix. A flame sensor for the pilot controls the flow of gas to the pilot source and ignition of the pilot source.

15 Claims, 1 Drawing Sheet

FIREPLACE WITH DESTRUCTION OF PRODUCTS OF INCOMPLETE COMBUSTION ENHANCED BY A GASEOUS-FUELED PILOT BURNER

RELATION TO CO-PENDING APPLICATION

The present application is a continuation-in-part of commonly assigned, co-pending application Ser. No. 07/788,899, entitled "Single Chamber Woodstove with Destruction of Products of Incomplete Combustion Enhanced by a Gaseous-Fueled Pilot Burner," filed Nov. 7, 1991, now scheduled to issue as U.S. Pat. No. 5,179,933 Jan. 19, 1993. The subject matter of the co-pending application is incorporated herein by reference.

FIELD OF THE INVENTION

The present invention relates generally to wood burning fireplaces and more particularly to a method of operating such fireplaces and to a structure for such fireplaces wherein hydrocarbon gas from a source outside of the fireplace is introduced into the fireplace to combust particulate emissions from wood burning in the fireplace.

BACKGROUND ART

Surveys of United States home buyers consistently place a fireplace as a first or second most sought-after "extra." The vast majority of American homeowners, and many living in apartments, desire a fireplace. A traditional residential fireplace is essentially a semi-open box having a pair of side walls, a rear wall, an open front face, a floor where wood chunks are placed or on which a grate for wood chunks is located so that the chunks burn in proximity to the floor, and a flue through a roof of the box.

Typically, homeowners operate fireplaces over a wide range of burn rates, with the average being approximately 4.5 kilograms of dried wood per hour. Because of the large amount of air entering the fireplace through the open face thereof, the temperature above the burning wood is too low to ignite and burn the air pollutants. It is, therefore, desirable to provide a steady, reliable ignition source above a wood charge in a fireplace for initiating and maintaining combustion of the pollutants.

A problem with the traditional fireplace is that there are substantial particulates emitted from the fireplace and which escape into the atmosphere through the flue and a chimney. Only the surfaces of the wood chunks can burn, and the entire chunk gets relatively hot, leading to fractional distillation of organic compounds from within the wood. The compounds are released into a combustion chamber formed by the fireplace. If the compounds are not completely burned, they become air pollutants upon discharge from the flue.

There are approximately 80 regions in the United States which fail to attain environmental standards for particulate matter having diameters of less than 10 micrometers. Residential wood combustion, typically from wood burning fireplace sources, is a very substantial reason why these environmental standards are not reached in these regions. The various states of the United States are soon to be required to show significant progress towards achieving attainment of the environmental particulate matter standards.

A current plan for residential fireplaces is to allow only gas log units in new construction and to encourage changeover of existing wood burning fireplaces to gas log units. The gas log units must not be convertible, under the plan, to wood burning fireplaces. Wood burning fireplace use in existing facilities will be banned in the 80 regions on "no burn days."

Because of these plans and the desire of many residents to have wood fireplaces, gas log fireplaces have recently been redesigned to produce flames for closely simulating burning wood flames. These new designs are the result of a recent American Gas Association rule permitting up to 400 parts per million of carbon monoxide in flue gases from gas log fireplaces. However, these substantial carbon monoxide emissions also have a substantial detrimental environmental effect. In addition, it is probable that gas log fireplaces contribute some particulates to the environment.

Hence, there are environmental problems associated with the gas log fireplaces. In addition, most residents prefer an actual wood fire to gas logs, despite the realistic nature of gas log flames.

It is, accordingly, an object of the present invention to provide a new and improved wood burning fireplace and to a method of operating same so there is a substantial reduction of particulate emissions from such fireplaces.

Majestic, the largest United States manufacturer of factory built, zero clearance wood burning fireplaces, recently introduced such a fireplace including a baffle in proximity to the flue, to provide a circuitous flow path for gasses flowing from wood in the fireplace to the flue. The baffle carries secondary air tubes. Air from outside the fireplace is supplied to the secondary air tubes to provide secondary combustion in the fireplace, and thereby, reduce, to a certain extent, particulate emissions flowing from the wood fire to the flue. The typical wood burning fireplace has a particulate emission factor of 10.8 grams per dry kilogram of burned wood. In the Majestic wood burning fireplace, the particulate emission factor is reduced to the 2–4 gram per kilogram range.

In the co-pending application, there is disclosed a woodstove in which gas from a hydrocarbon source outside of the woodstove flows to a pilot source in a secondary combustion zone of the woodstove. A gas flow valve for the hydrocarbon gas from the external source and an ignitor for the pilot are controlled in response to a sensor for the presence and absence of the pilot flame.

It is another object of the invention to provide a new and improved wood burning fireplace and method of operating same, incorporating techniques and apparatus similar to those disclosed in the co-pending application.

Another object of the invention is to provide an insert for a wood burning fireplace for substantially reducing the amount of particulates emitted from the fireplace.

A further object of the invention is to provide a wood burning fireplace and a method of operating same wherein particulate emissions are less than one gram for each kilogram of dry burned wood.

THE INVENTION

In accordance with one aspect of the present invention, particulate emissions from a wood fire burning in a fireplace are reduced by applying an ignited hydrocarbon gas from a source outside of the fireplace to the particulate emission flowing from the fireplace to the flue. The ignited hydrocarbon gas combusts the particulate emissions. The ignited hydrocarbon gas is applied to the emissions while the emissions are still in the fireplace and before the emissions reach a chimney flue for the fireplace. Products of combustion from the wood fire and the combusted particulate emissions are deflected by a baffle while they are in the fireplace and before they flow into the flue so the products of combustion from the wood fire and the combusted particulate emissions have a circuitous path from the fireplace to the fire. The hydrocarbon gas from the source preferably flows into the fireplace at a rate of 1–3 standard cubic feet per hour so the ignited gas applied to the particulate emission can be considered as being from a pilot source.

Another aspect of the invention is directed to the combination of a fireplace having a back wall, a pair of side walls, an open front face, a flue and a floor. The fireplace is arranged so a wood fire is adapted to be on or in close proximity to the floor. A baffle in proximity to the flue prevents the direct flow of fluid into the flue from the wood fire. A hydrocarbon gas pilot source in proximity to the baffle combusts particulate emissions from the wood fire while they are in the fireplace and before they reach the flue. The combination provides reduced particulate emissions from the fireplace to a rate of less than one gram per kilogram of dried burned wood.

In the preferred embodiment, the gas pilot source is proximate the back wall and remote from the front face in a portion of the fireplace having a relatively low oxygen concentration and low air velocity to "anchor" the pilot flame. Air from outside the fireplace is supplied into proximity with ignited gas from the pilot source so the outside air and the ignited pilot gas mix.

The presence of a flame in the pilot source is preferably sensed and used to control the flow of gas to the pilot source and to ignite the pilot source, in a manner similar to that disclosed in the co-pending application.

Another aspect of the invention is directed to an insert for a wood fire fireplace having a baffle in proximity to a flue for preventing the direct flow of fluid into the flue from the wood fire. The insert comprises a hydrocarbon gas pilot source adapted to be located in proximity to the baffle for combusting particulate emissions from the wood fire while they are in the fireplace and before they reach the flue.

The above and still further objects, features and advantages of the present invention will become apparent upon consideration of the following detailed description of a specific embodiment thereof, especially when taken in conjunction with the accompanying drawings.

DESCRIPTION OF THE PREFERRED EMBODIMENT

Figure 1:
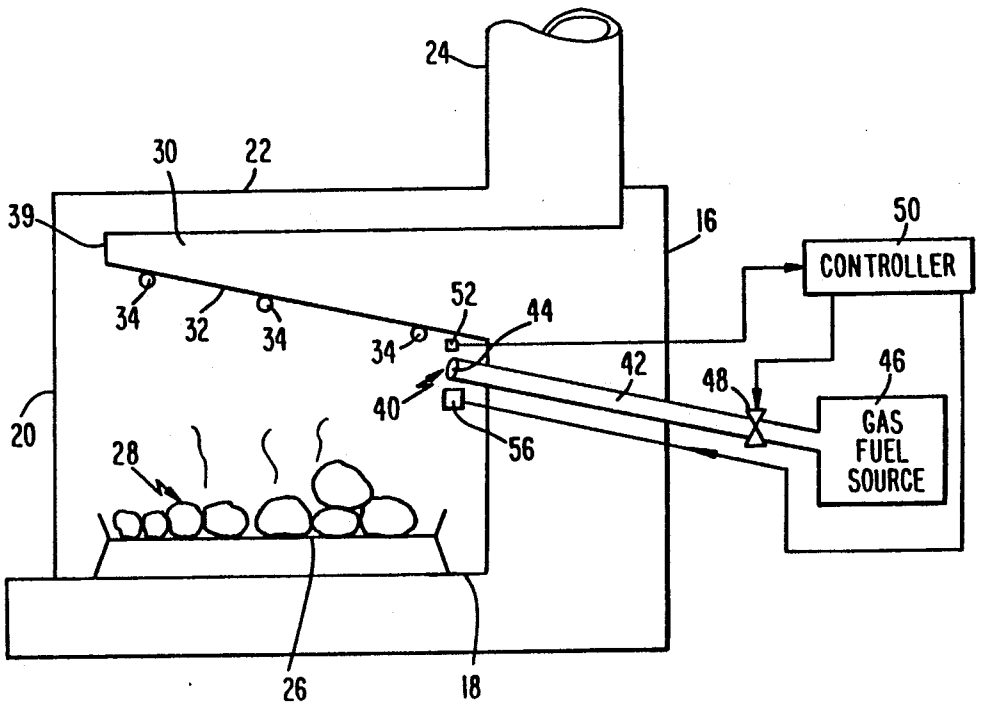
FIG. 1 is a schematic side view of a fireplace including the present invention.
Figure 2:
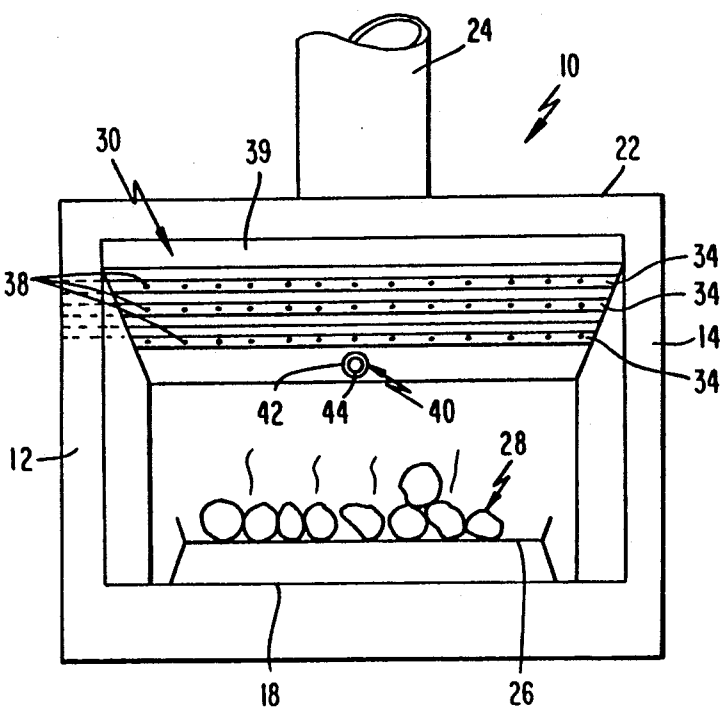
FIG. 2 is a front view of the fireplace of FIG. 1.

Reference is now made to FIGS. 1 and 2 of the drawing wherein wood burning fireplace 10 is illustrated as including side walls 12 and 14, back wall 16, floor 18, front face 20, roof 22 and flue 24 which extends through the roof. Grate 26 is located on floor 18 and carries burning wood chunks 28, typically dried and split logs. Baffle 30 extends from the region of rear wall 16 forwardly, proximate and somewhat inside of front face 20. Baffle 30 has an upwardly slanting lower face 32 on which are mounted parallel metal tubes 34 that extend between side walls 12 and 14. Metal tubes 34 extend through side wall 12 so that air from outside of the fireplace flows through them. The air flowing through metal tubes 34 escapes from the metal tubes 34 through vent holes 38 that extend completely along the length of the metal tubes 34 between side walls 12 and 14. Three such parallel sets of metal tubes 34 are located on baffle wall 30.

Baffle 30 also includes face 39 which extends generally parallel to roof 22 of fireplace 10. A circuitous path is thereby provided for fluid flowing from the fire established by burning wood chunks 28. Baffle 30 provides a circuitous path for the fluid, i.e., combusted gases and particulates from the fire. A secondary combustion zone is thereby formed in fireplace 10 just below lower face 32 of baffle 30.

The previously described structure of FIGS. 1 and 2 is incorporated in the Majestic fireplace and has been found to reduce emissions of particulate matter having diameters less than 10 micrometers from 10.8 grams per kilogram of dry burned wood to approximately 2 to 4 grams per kilogram of burned dried wood chunks 28. In accordance with the present invention, the emission of particulate materials having a diameter of less than 10 micrometers is further reduced to less than one gram per kilogram of dried burned wood chunks 28.

This result is achieved by equipping fireplace 10 with hydrocarbon gas pilot flame source 40, including pipe 42 that projects through rear wall 16 into a region of fireplace 10 that is approximately equidistant between side walls 12 and 14 and is close to rear wall 16, slightly below lower face 32 of baffle 30, and fairly close to the metal tube 34 in closest proximity to the rear wall. Pipe 42 has an opening 44 through which a gaseous hydrocarbon fuel escapes at a rate of approximately 1–3 standard cubic feet per hour, to form a pilot flame. (A flow rate of standard cubic foot per hour is a flow of 1 cubic foot per hour at a pressure of 1 atmosphere and a temperature of 68° F.) Flow is desirably in the 1–3 standard cubic feet per hour range because a flow in excess of this amount is unnecessary and wasteful of fuel of gas pilot flame source 40, while a flow rate of less than one standard cubic foot per hour is usually insufficient to provide adequate ignition of the particulates from burning wood chunks 28.

The hydrocarbon gas flows to pipe 40 from gaseous fuel source 46, located outside of fireplace 10 via valve 48. Source 46 can be any suitable hydrocarbon gas source, such as natural gas, butane, or liquid petroleum gas. Opening and closing of valve 48 is in response to signals derived by controller 50, in turn responsive to flame sensor 52, in proximity to opening 44. Controller 50 also supplies signals to ignitor 56, in proximity to opening 44, to control ignition of the gas flowing through the opening. Controller 50 is preferably constructed basically in the manner disclosed in the co-pending application.

Opening 44 is located close to the intersection of back wall 16 and the bottom face of baffle 30 because this location tends to "anchor" the flame, i.e. prevents uncontrolled spreading of the ignited low velocity gas flowing through opening 44. However, this is a region of the fireplace where the oxygen concentration and air velocity are relatively low, i.e., this region is "starved" of air, which tends to reduce the amount of oxygen which can intermix with the hydrocarbon gas flowing through opening 44. The proximity of opening 44 with openings of metal tube 34 closest to rear wall 16, however, causes mixing of the hydrocarbon gas flowing through opening 44 and air flowing through the holes of this metal tube 34.

The Hearth Products Association estimates that at least 80 percent of all new homes built in the United States are equipped with a fireplace. For every one million new homes in the United States, there are therefore approximately 800,000 new fireplaces. The average wood consumption in wood burning fireplaces is estimated at 0.8 cords per year, the equivalent of 1.163 dry tons per year, i.e., 1,057 kilograms per year. Since each prior art fireplace has a particulate emission factor of about 10.8 grams per kilogram of dried wood, there would be an increase of particulate emissions having diameters less than 10 micrometers of 10,000 tons for every million new homes built in the United States if no changes are made. By using the present invention the emissions of particulates having diameters of less than 10 micrometers are very substantially reduced to less than one gram per kilogram of dried burned wood, resulting in a reduction to under 100 tons for each million new homes built in the United States.

While there has been described and illustrated one specific embodiment of the invention, it will be clear that variations in the details of the embodiment specifically illustrated and described may be made without departing from the true spirit and scope of the invention as defined in the appended claims.

We claim:

1. A method of reducing particulate emissions from a wood fire burning in a fireplace having a combustion chamber, comprising the steps of combusting the particulate emissions by applying an ignited hydrocarbon gas from a source outside of the fireplace to the particulate emission flowing from the fire to the flue while the emissions are still in said combustion chamber and before the emissions reach a chimney flue for the fireplace and deflecting products of combustion from the wood fire and the combusted particulate emissions while they are in said combustion chamber and before they flow into the flue so the products of combustion from the wood fire and the combusted particulate emissions have a circuitous path from the fire to the flue.

2. The method of claim 1 wherein the hydrocarbon gas from the source flows into the fireplace at a rate in the range of 1–3 standard cubic feet per hour.

3. The method of claim 2 wherein the ignited hydrocarbon gas from the source is applied to a region of the fireplace having a relatively low oxygen concentration and low air velocity, and mixing air supplied to the region from outside of the fireplace with the hydrocarbon gas.

4. The method of claim 1 wherein the ignited hydrocarbon gas from the source is applied to a region of the fireplace having a relatively low oxygen concentration and low air velocity, and mixing air supplied to the region from outside of the fireplace with the hydrocarbon gas.

5. In combination, a fireplace having a combustion chamber defined by a back wall, a pair of side walls, an open front face, a floor, and a baffle opposite said floor, the fireplace being arranged so a wood fire is adapted to burn in the combustion chamber on or in close proximity to the floor, the baffle is in proximity to an exhaust flue for preventing the direct flow of fluid into the flue from the wood fire, and a hydrocarbon gas pilot source in said combustion chamber in proximity to the baffle for combusting particulate emissions from the wood fire while they are in the combustion chamber and before they reach the flue.

6. The combination of claim 5 further including means for sensing the presence of a flame in the pilot source, and means responsive to the sensing means for controlling the flow of gas to the pilot source and for igniting the pilot source.

7. Apparatus for reducing particulate emissions from a wood fire in a fireplace having a combustion chamber defined by a back wall, a pair of side walls, an open front face, a floor, and a baffle opposite said floor, the fireplace being arranged so a wood fire is adapted to burn in the combustion chamber on or in close proximity to the floor, said baffle adapted to be located in proximity to the flue for preventing the direct flow of fluid into the flue from the wood fire, and a hydrocarbon gas pilot source in said combustion chamber in proximity to the baffle for combusting particulate emissions from the wood fire while they are in the combustion chamber and before they reach the flue.

8. The apparatus of claim 7 wherein the gas pilot source is proximate the back wall and remote from the front face in a portion of the fireplace having a relatively low oxygen concentration and low air velocity, and means for supplying air from outside of the fireplace into proximity with ignited gas from the pilot source so the outside air and the ignited pilot gas mix.

9. The apparatus of claim 8 further including means for sensing the presence of a flame in the pilot source, and means responsive to the sensing means for controlling the flow of gas to the pilot source and for igniting the pilot source.

10. The apparatus of claim 7 further including means for sensing the presence of a flame in the pilot source, and means responsive to the sensing means for controlling the flow of gas to the pilot source and for igniting the pilot source.

11. An insert for a fireplace having a combustion chamber defined by a back wall, a pair of side walls, an open front face, a floor, and a baffle opposite said floor, the fireplace being arranged so a wood fire is adapted to burn in the combustion chamber on or in close proximity to the floor, said baffle is in proximity to the flue for preventing the direct flow of fluid into the flue from the wood fire, the insert comprising a hydrocarbon gas pilot in said combustion chamber adapted to be located in proximity to the baffle for combusting particulate emissions from the wood fire while they are in the combustion chamber and before they reach the flue.

12. The insert of claim 11 further including means for sensing the presence of a flame in the pilot source, and means responsive to the sensing means for controlling the flow of gas to the pilot source and for igniting the pilot source.

13. The insert of claim 11 wherein the pilot source includes a conduit having the capacity of supplying hydrocarbon gas fuel from a source outside of the fireplace at a rate in the range of 1–3 standard cubic feet per hour.

14. In combination, a fireplace having a back wall, a pair of side walls, an open front face, a flue and a floor, the fireplace being arranged so a wood fire is adapted to be on or in close proximity to the floor, a baffle in proximity to the flue for preventing the direct flow of fluid into the flue from the wood fire, and a hydrocarbon gas pilot source in proximity to the baffle for combusting particulate emissions from the wood fire while they are in the fireplace and before they reach the flue, said gas pilot being proximate the back wall and remote from the front face in a portion of the fireplace having a relatively low oxygen concentration and low air velocity, and means for supplying air from outside of the fireplace into proximity with ignited gas from the pilot source so the outside air and the ignited pilot gas mix.

15. The combination of claim 14 further including means for sensing the presence of a flame in the pilot source, and means responsive to the sensing means for controlling the flow of gas to the pilot source and for igniting the pilot source.

* * * * *